US007555994B1

(12) United States Patent
Arnall

(10) Patent No.: US 7,555,994 B1
(45) Date of Patent: Jul. 7, 2009

(54) PONTOON BOAT COVER SYSTEM WITHOUT RIDGE OR GUY POLES

(76) Inventor: Randall E. Arnall, 4480 E. Winding Oak Bend, Springfield, MO (US) 65803

( * ) Notice: Subject to any disclaimer, the term of this patent is extended or adjusted under 35 U.S.C. 154(b) by 57 days.

(21) Appl. No.: 11/891,312

(22) Filed: Aug. 9, 2007

Related U.S. Application Data

(63) Continuation-in-part of application No. 11/725,579, filed on Mar. 19, 2007, now abandoned.

(60) Provisional application No. 60/784,507, filed on Mar. 21, 2006.

(51) Int. Cl.
*B63B 17/00* (2006.01)

(52) U.S. Cl. ..... 114/361

(58) Field of Classification Search ..... 114/361; 135/88.15, 129
See application file for complete search history.

(56) References Cited

U.S. PATENT DOCUMENTS

| | | | | | |
|---|---|---|---|---|---|
| 2,493,833 | A * | 1/1950 | Reynolds | 114/361 |
| 2,618,285 | A * | 11/1952 | Heisig | 135/90 |
| 2,714,387 | A * | 8/1955 | Meldrum | 114/361 |
| 3,032,046 | A * | 5/1962 | Coonradt | 135/90 |
| 3,354,892 | A | 11/1967 | Frieder | 114/361 |
| 3,367,349 | A * | 2/1968 | O'Link | 114/361 |
| 3,530,623 | A * | 9/1970 | Burton | 52/86 |
| 4,979,456 | A | 12/1990 | Steward | 114/351 |
| 5,070,807 | A | 12/1991 | Lewis | 114/361 |
| 5,413,063 | A * | 5/1995 | King | 114/221 R |
| 6,260,505 | B1 | 7/2001 | Polidan | 114/361 |
| 6,978,731 | B2 | 12/2005 | Erbetta | 114/361 |
| 2004/0045493 | A1 * | 3/2004 | Schmidt | 114/361 |
| 2006/0086306 | A1 * | 4/2006 | Murphy | 114/361 |
| 2006/0090686 | A1 * | 5/2006 | Thompson | 114/361 |
| 2006/0137593 | A1 * | 6/2006 | Brooks et al. | 114/361 |

* cited by examiner

*Primary Examiner*—Stephen Avila
(74) *Attorney, Agent, or Firm*—Jonathan A. Bay

(57) ABSTRACT

A pontoon boat's cover system has includes a rib-cage structure to support a fabric cover formed by hollow poles flexed into low arches and anchored into opposite brackets on the left and right top (hand or side) rails of the pontoon boat. Each bracket has a zig-zag pin and a U-base. Each zig-zag link originates as a bottom axle changing into a central column changing into a cantilevered stake. Each U-based cups a top rail of the boat with a bottom axle inserted through holes in the U-base across and over the top rail it cups. The central column seats in a saddle of one of the U-base's arms to stabilize the zig-zag pin the front to back direction. A locking collar slides over the saddle with the central column seated therein in order to retain the zig-zag pin from unseating from the saddle.

14 Claims, 4 Drawing Sheets

PONTOON BOAT COVER SYSTEM WITHOUT RIDGE OR GUY POLES

CROSS-REFERENCE TO RELATED APPLICATION(S)

This application is a continuation-in-part of U.S. patent application Ser. No. 11/725,579, filed Mar. 19, 2007, now abandoned which claims the benefit of U.S. Provisional Application No. 60/784,507, filed Mar. 21, 2006, the disclosures of which are incorporated in full by this reference thereto.

BACKGROUND AND SUMMARY OF THE INVENTION

It is known to provide canopy or cover systems for boats to protect the interior from inclement weather. Few available cover systems are for pontoon boats. An example of one, however, is prior art U.S. Pat. No. 6,260,505—Polidan. It comprises a frame assembly bearing resemblance to campground tents. The frame assembly comprises a series of A-framed rafters connected rigidly tied together at their crowns by a ridge pole, which ridge pole at its forward and rearward ends connects to fore and aft guy-poles. All of the bottom ends of the A-framed rafters and guy-poles are inserted into sockets provided by brackets attached to the gunwales (or top hand rails) of the pontoon boat. Every intersection between the ridgepole and any rafter is preferably connected by a four way fitting. Col. 3, line 1. The connections between the ridge-pole and guy-poles requires at least a two-way fitting.

Shortcomings with the prior art include the length of time and number of steps it takes to erect the framework assembly from a disassembled state. It appears if the A-framed rafters, ridge pole and guy-poles either have to be sized to fit at the factory for a specific model of boat or otherwise, at home, the job will certainly be a two person job.

It also appears if the A-framed rafters are not self-supporting on one leg alone:—that is, it appears as if each A-framed rafter requires both legs planted in the starboard and port socket therefor before it truly can be self-standing. It furthermore appears if the A-framed rafters are not independently strong enough to withstand the pontoon boat being trailered down the roadway at highway speeds. That is, the pressure on the textile cover over the bow of the boat at highway speed is likely to buckle the A-framed rafters over backwardly:—hence that is why there is inclusion of the ridge pole as well as the fore and aft guy poles. It moreover appears if the task of connecting up the ridge and guy poles with the spaced apart A-framed rafters would best be handled by two persons working together, and still take as long as one person along who is just setting up the A-frame rafters.

It appears if all the pressure required to keep any pole (ridge, guy or A-frame) inserted in its sockets is supplied only by lashing down the textile cover. In other words, until the cover is lashed down, it appears if any pole can readily be slipped out of its socket. That would tend to make the task of stretching the textile cover over the bare framework a harder job for one person than several. That is, one person working alone has to drag the cover over the bare framework just to get the cover in place for lashing. The act of dragging the cover over the bare framework unless done with some care appears to present a great chance of unseating some of the poles out of their sockets.

On boats with Bimini tops, the collapsed supports cover up the top rail along the starboard and port sides. Hence there is no room to attach brackets in accordance with the prior art under such a collapsed Bimini top.

It also appears if the prior art pontoon boat canopy system is a rather tall structure. That is, once erected, any pontoon boat covered by such might be taller than the standard eight foot (~2.4 m) door openings common to most rental boat lockers. That is, for many homeowners, if their pontoon boat cover system is too tall, they can forget about pulling into town after vacation and immediately parking the boat in their rented boat locker. The first thing they will have to do is take down the cover system.

What is needed is a solution to the shortcomings of the prior art.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
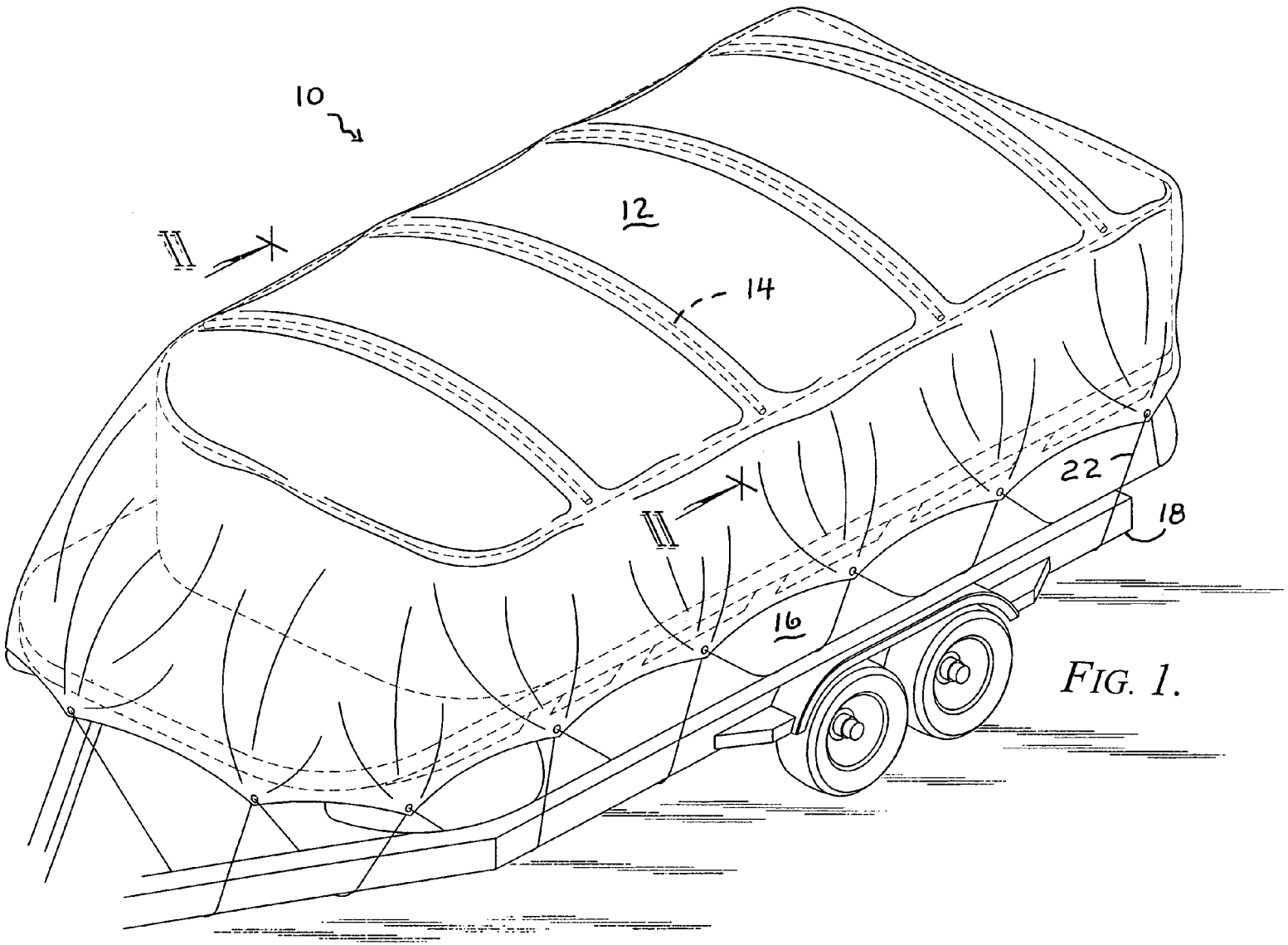
FIG. 1 is a perspective view of a ridgepole-less, pontoon boat cover system in accordance with the invention, as shown with a soft (eg., woven or non-woven fabric) cover stretched over not only the arches of the cover system but also a pontoon boat as well, as its sits on its trailer.

FIG. 1 shows a ridgepole-less pontoon boat cover system 10 in accordance with the invention, as shown with a soft (eg., woven or non-woven fabric) cover 12 stretched over not only several arches 14 of the cover system 10 but also a pontoon boat 16 as well, as it sits on its trailer 18. The soft cover 12 is lashed down by lashing 22 as appropriate which, as shown, lashes around the trailer.

It is an aspect of the invention that the work of spreading out the soft cover 12 and lashing it down is readily a one worker job with the ridgepole-less, pontoon boat cover system 10 in accordance with the invention.

It is another aspect of the invention that the one-time-only job of originally customizing to size the system of arches 14 to fit a specific pontoon boat (eg., 16) is likewise—comfortably—a one worker job.

Figure 2:
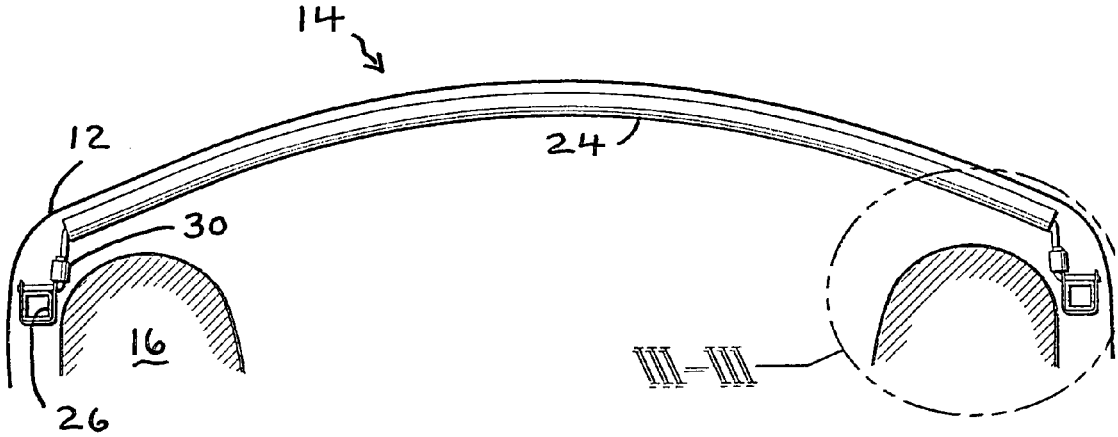
FIG. 2 is a partial sectional view taken in the direction of arrows II-II in FIG. 1.

FIG. 2 shows that an arch 14 in accordance with the invention comprises a stiffly-flexible (hollow) pole 24 flexed in an arch between the spaced port and starboard top (hand or side) rails 26, the opposite ends of which arch pole 24 are secured by a pair of identical bracket assemblies 30 in accordance with the invention. Accordingly, the bracket assemblies 30 are uniform among one another:—there is no difference between brackets 30 on the port side or starboard side of the boat 16. Also, the arch poles 24 are stiffly-flexible tubeforms (ie., while they are not inflexible, they are far from being willowy pliant). Suitable tubeforms include without limitation PVC pipes commonly available from hardware stores and the like.

It is a design preference to utilize PVC pipes (or the like) that have an aspect ratio such that the outside diameter is relatively small in contrast to the sidewall thickness, which is relatively thick. That way, relatively elongated lengths of such PVC pipe behave somewhat like a longbow, which is straight and limber when unstrung, but flexes into a stiff arch when strung. Similarly with PVC pipes, they stiffen when flexed into service as arch pole 24 shown in FIG. 2, but when released from the squeeze supplied by the opposite brackets 30, the PVC pipe (eg., pole 24) straightens out again, typically without much set.

A user can customize the degree of arch between extremes of flat (ie., zero arch) to high by trimming PVC pipe stock to size to produce a pole 24 having a length between corresponding extremes of short and long. That way, a user might prefer to customize things so that the arches 14 soar high, so that the cover 12 spreads over (eg.,) the superstructure of the helm. Or alternatively, given a different boat, the user might prefer to customize things so that the arches 14 are low, so that a low profile cover system 10 and trailered pontoon boat 16 can still be parked in a marine rental locker or the like, especially for even for marine rental lockers having a standard-size garage door opening of eight foot ("two-and-a-half meters). Some homeowners even have garages or outbuildings with garage doors that tall. Accordingly, it is an aspect of the invention that the user can customize the height of arch 14, whether he or she want complete uniformity, or otherwise, like taller in the middle while lower fore and aft.

It is an aspect of the invention to dispense with any ridgepole, as extending fore-to-aft and tying together all the beam-to-beam arches (eg., 14). Among other reasons for this, some pontoon boats (unlike the one illustrated by U.S. Pat. No. 6,260,505) lack a readily accessible back rail. That is, the back rail of the boat shown in FIG. 1 of the priority U.S. patent application Ser. No. 11/725,579 (filed Mar. 19 of 2007, and incorporated herein by this reference thereto) is covered by an upholstered cushion comprising a sun deck. Accordingly, that arrangement of a back rail is sort of eliminated from candidacy as a place to mount a rail bracket like Polidan's for Polidan's rear guy-pole. Even if a bracket could be wiggled into the tight space under the upholstery and onto the back rail, there is then no clearance to arc the rear guy-pole for its intended purpose.

Another advantage of the invention pertains more particularly to the configuration of the bracket 30. For background, the pontoon boat shown in FIG. 1 of the priority U.S. patent application Ser. No. 11/725,579 has a Bimini top carried by a collapsible tower. With the tower collapsed, the top hand or side rail (eg., 26) along the beam of the boat is covered up by the canvas of the Bimini top in some places, and by the tower's legs in others.

In consequence, the obstructions of the Bimini's canvas or the tower's legs eliminate those sections of top hand rail (eg., 26) that they obstruct as candidate places for the bracket of U.S. Pat. No. 6,260,505—Polidan. But if the brackets could be squeezed in place, the Bimini top's tower's legs do not allow clearance for the legs of the A-framed rafters. It is no solution to fix Polidan's brackets not to the hand rail (eg., 26) but to the legs of the tower. The tower's legs are not suitable places to attach brackets, especially if the pontoon boat is going to be trailered down the highway with the cover system in place. The tower's legs are too weak for that service, unlike that top (hand or side) rail 26 along the beam of pontoon boats 16.

The inventive bracket assembly 30 in accordance with the invention accommodates obstructions like Bimini tower legs by situating all its structure taller than the top rail 26 to a spaced position laterally away therefrom, including without limitation on the inboard side as shown.

Figure 5:
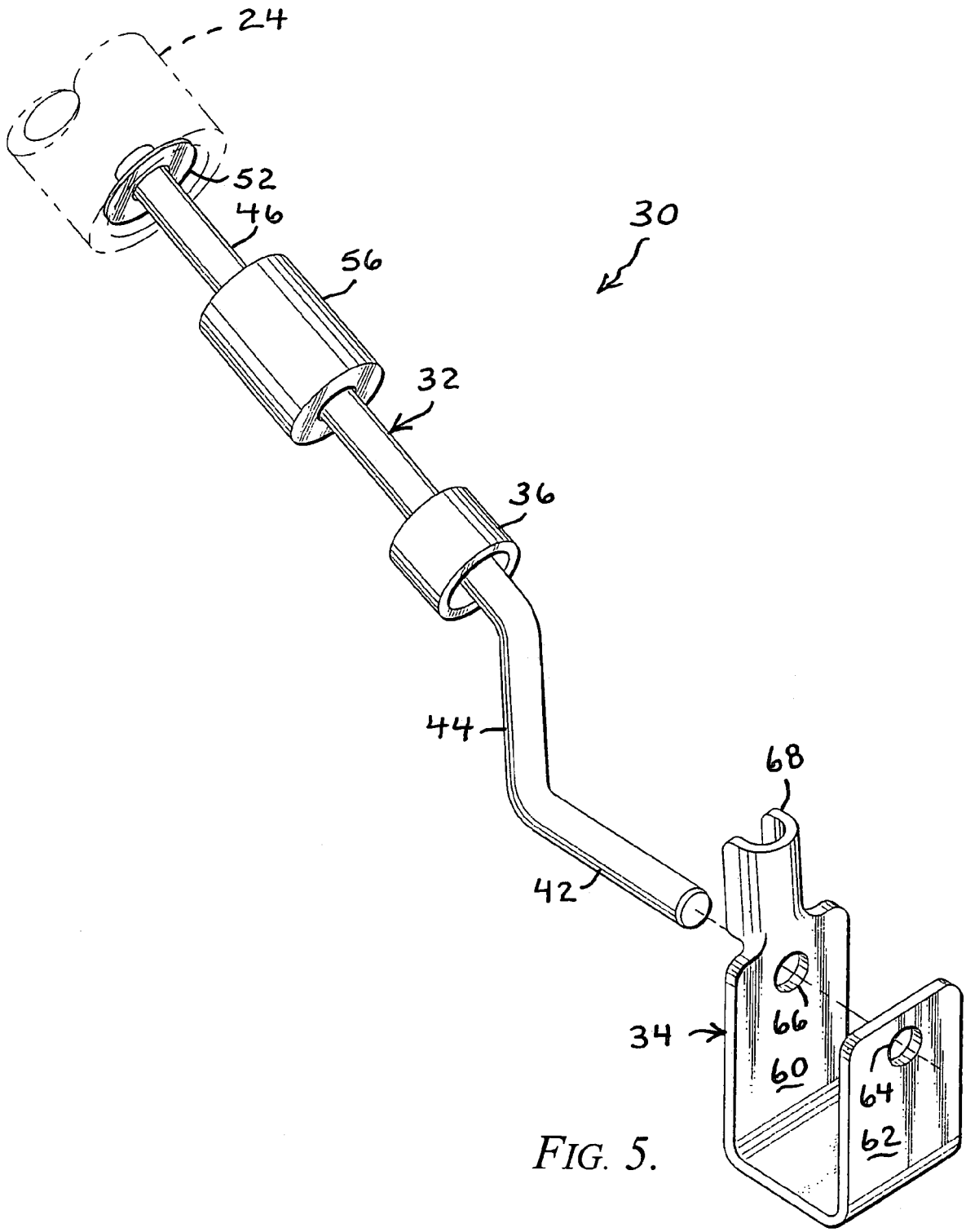
FIG. 5 is a perspective view comparable to FIG. 4 except exploded.

The ridgepole-less pontoon boat cover system 10 in accordance with the invention is preferably marketed to the end-user/retail consumer as a kit of components that assemble together to make several brackets 30 (wherein FIG. 5 shows better the components that constitute one bracket 30). Optionally, the kit of components is marketed with or without pipes. If not, the user supplies his or her own pipe out of which to fashion the poles 24 for the arches 14.

Figure 4:
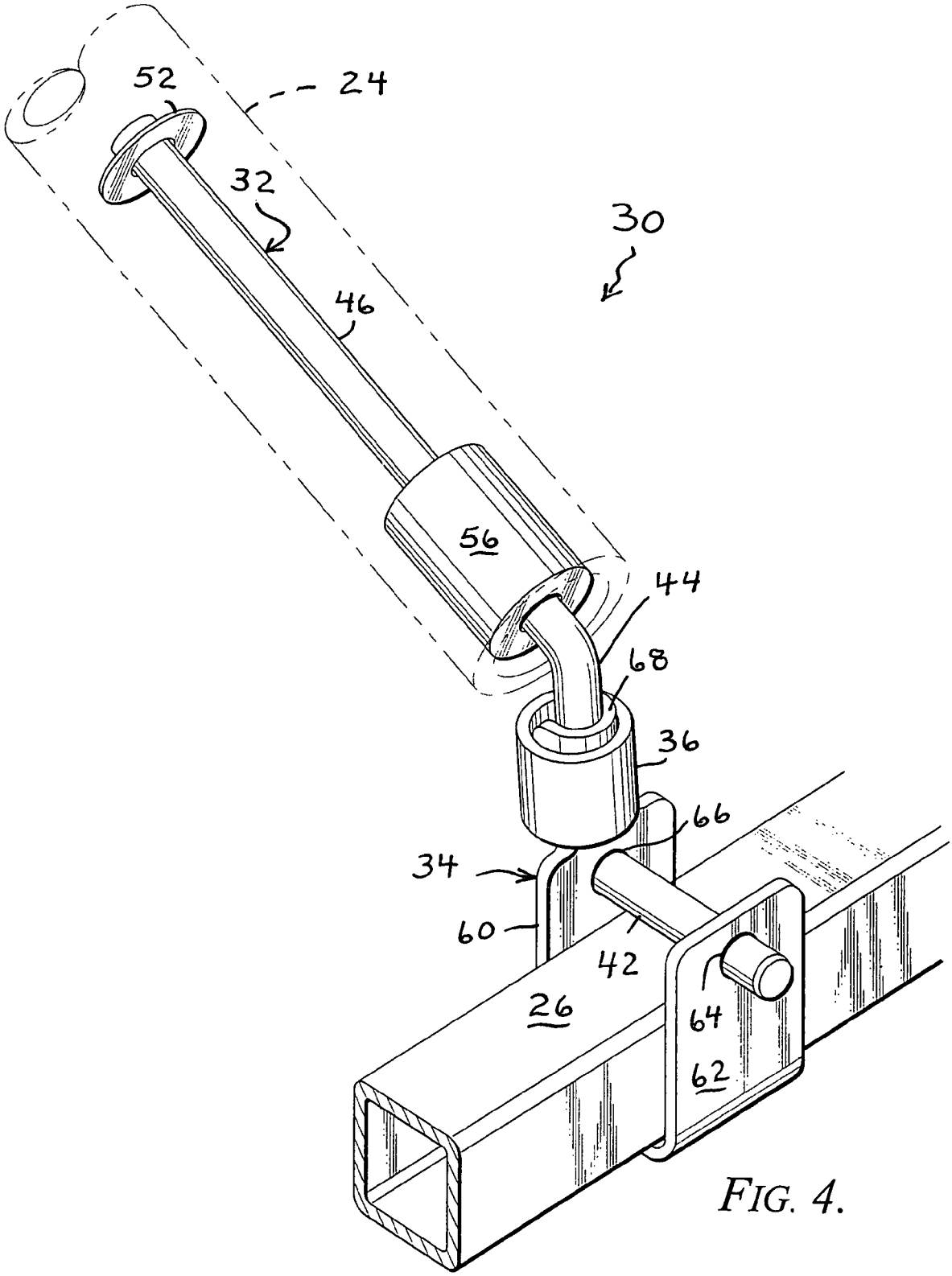
FIG. 4 is an enlarged scale perspective view of FIG 3.

With general reference to FIGS. 4 and 5, the bracket assembly 30 in accordance with the invention comprises a zig-zag pin 32, a U-shaped base (ie., U-base 34), and a locking collar 36. The zig-zag pin 32 comprises a lower (and outer as shown in the drawing) axle portion 42, a latching mid-span 44 that is also configured to protrude aside of and free from interference with directly overhead structure such as and without limitation legs of a Bimini tower (not shown), and a cantilevered stake portion 46. In essence, it is an aspect of the invention that the zig-zag pin 32 merely "zigs" and "zags" around overhead things like the Bimini tower's legs. It is a design preference that the mid-span 44 is situated on the inboard side of the U-base 34 but this is a design preference without limitation.

The cantilevered stake portion 46 projects inwardly as well as upwardly, and is outfitted with a set of conveniences comprising a bulbous head 52 (eg., a mushroom-style cap as shown in the drawings) and a bushing 56.

The U-base 34 is a channel comprising a web flanked by an inboard arm 60 and outboard arm 62. Both arms 60 and 62 are sized to provide excess upper portions which project higher than the top surface of the top (hand or side) rail 26. The outboard arm 62's upper excess portion is formed with an outboard-arm hole 64, as the inboard arm 60's upper excess portion is formed with a corresponding inboard-arm hole 66. One of the two arms 60 and 62 of the U-base 34 (eg., it is the inboard arm 60 as shown in the drawings) has its upper excess portion furthermore formed with a saddle 68 for purposes to be more particularly described below.

Whereas FIG. 4 shows the assembled bracket assembly 30, FIG. 5 allows better reckoning of the assembly steps. The first step is to cup the U-base 34 under a top rail 26 of the side of the boat 16 and orient the zig-zag pin 32 ready for coupling with the U-base 34. The user then inserts the (lower) axle portion 42 of the zig-zag pin 32 through an inboard-arm hole 66 in the U-base 34, over and across the top rail 26's top surface. The locking collar 36 is free to slide and can be held in an "up" and "out-of-the-way" position. FIG. 4 shows completion of the insertion of the (lower) axle portion 42 of the zig-zag pin 32 through not only the inboard-arm hole 66 in the U-base 34 but also the outboard-arm hole 66 as well. Again, the (lower) axle portion 42 is situated just clearing the top surface of the boat 16's top (hand or side) rail 26. Indeed, the (lower) axle portion 42 preferably rests in part on the top surface thereof. The U-base 34 is sized to cup the top rail 26 closely along the bottom and side surfaces thereof, and the U-base 34's through holes 64 and 66 are positioned such that the zig-zag pin 32's (lower) axle portion 42 rests closely upon the top surface of the top rail 26 as shown. In the industry, the size for rails (eg., 26) of pontoon boats are fairly standard, at least among the product line of any given manufacturer.

The zig-zag pin 32's latching mid-span 44 is nested (or seated, or "latched") in the saddle 68 of the U-base 34 to provide positional stability for it in the front to back direction. The locking collar 36 is allowed to slide down, and around, the U-base 34's saddle 68 in order to retain the zig-zag pin 32 from unseating out (eg, which corresponds to shifting out on the inboard side as shown in the drawings).

Figure 3:
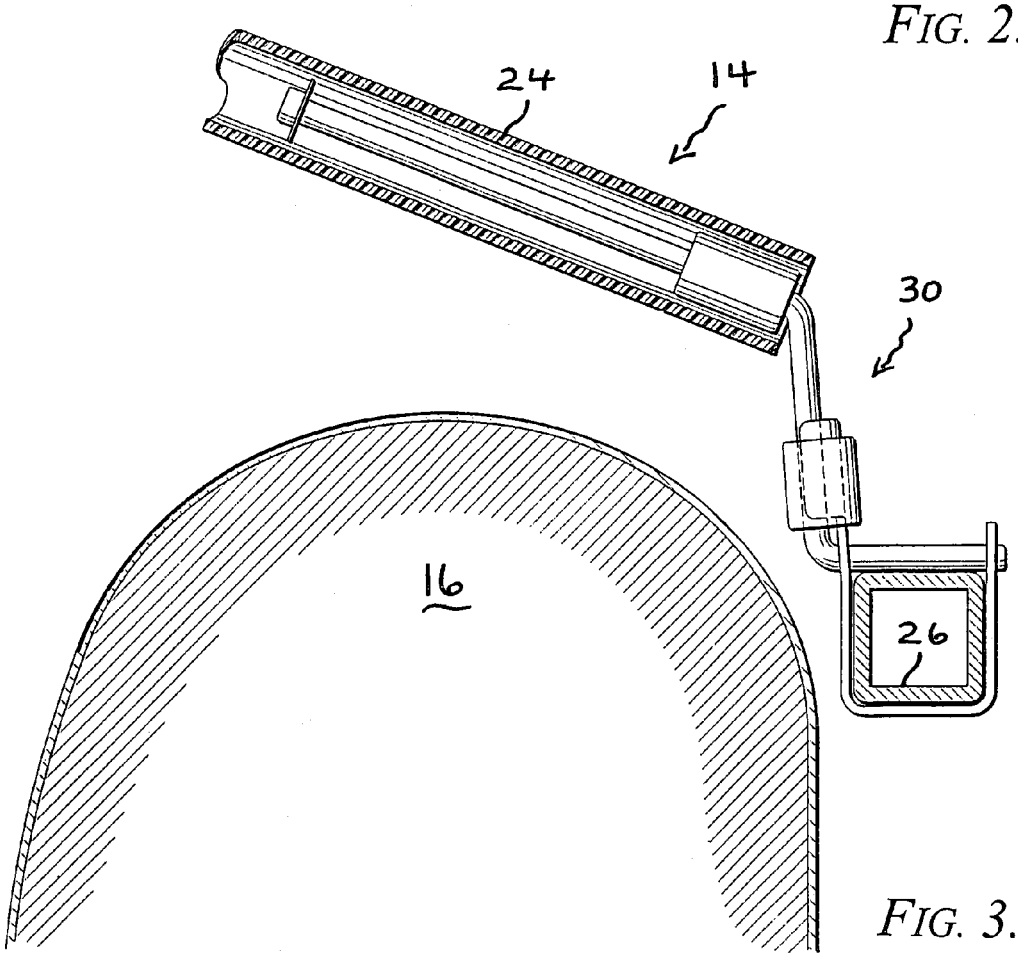
FIG. 3 is an enlarged-scale partial sectional view of detail III-III in FIG. 2.

FIG. 3 is a close up view of the bracket assembly, showing an end of one of the poles 24 over the zig-zag pin 32's cantilevered stake portion 46. The cantilevered stake portion 46 has a bulbous head 52 (eg., mushroom-shaped cap as shown in the drawings) with an outer diameter corresponding closely to the pole 24's inner diameter for a close fit therebetween. Here the user has aimed the pole 24's open end to slide over the bulbous head 52. FIG. 3 also shows that the cantilevered stake portion 46 carries a sliding sleeve on it that serves as a bushing 56. Whereas it is preferred to produce the zig-zag pin and U-base 32 and 34 of corrosion-resistant metal, it conversely preferred to product the busing and probably the locking collar 56 and 36 out of plastic.

Hence, the plastic busing 56 is free to slide on the cantilevered stake portion 46 but it will normally come to rest at the bottom. The busing 56's outer diameter is sized to correspond closely to the pole 24's inner diameter for a close fit therebetween. Given the foregoing, once the inventive pontoon boat cover system 10 is customized to size for a specific boat, users can thereafter take down and put back up the arches 14 with much less fuss.

FIG. 4 shows bracket 30 affixed to the top rail 26 and supporting one end of arched pole 24 by the zig-zag pin 32's cantilevered stake portion 46. FIG. 4 also shows completion of the positioning of the locking collar 36. It slides around the U-base 34's saddle 68 in order to retain the zig-zag pin 32 from shifting out (eg., inboard as shown in the drawing). The locking collar 36 merely provides double assurance that the zig-zag pin 34's latching mid-span 44 will not unseat form the U-base 34's saddle 68.

That is, the pole 24's inherent property of wanting to straighten out probably supplies sufficient pressure on the zig-zag pin 34's latching mid-span 44 to not unseat from the U-base 34's saddle 68. Also, the seating (or "latching") of the zig-zag pin 32's mid-span 44 in the U-base 34's saddle 68 further prevents the zig-zag pin 32's (lower) axle portion 42 from rotating in the U-base 34's through holes 34 and 66. It is an aspect of the invention that the flexion of the poles 24 force a twist on the engagement of the U-bases 34 with the boat 16's top rail 26. The zig-zag pin 32's (lower) axle portion 42 is rocked a little (not clearly perceptible in FIG. 3) on the inboard bend such that the outboard end is a little kicked up, and spaced off the top rail 26's top surface (again, none of this is clearly perceptible in FIG. 3). This twist induces the U-base 34 and zig-zag pin 32's (lower) axle portion 42 to bind or pinch on the top rail 26, thereby promoting more secure positional stability of the bracket assembly 30.

FIG. 2 shows one completed arch 14. Such an arch 14 comprises a custom trimmed-to-size pole 24 flexed and staked between two opposing brackets 30.

So for a new owner of the ridgepole-less, pontoon boat cover system 10, there is one-time-only job to undertake with the first use the system 10 which comprises customizing the length of the poles 24. Preferably a user starts with pipe stock that is longer than needed. To begin, the user sticks one end of the pipe on one bracket 30 then flexes the pipe to the desired degree of arch and measures where the pipe should be trimmed (this is not shown). Then the user relaxes the compression on the flexed pipe in order to trim it to size (eg., as with a hand saw or loppers). The cut-off end piece can be discarded. Given the foregoing, the user has produced one pole 24. The user sticks one end of the pole 24 on one bracket 30, flexes the pole 24 in an exaggerated arch in order to stick its opposite end on the other bracket 30. The result is completion of one arch 14, which comprises the trimmed-to-size pole 24 as flexed and staked between two opposed bracket assemblies 30.

Wherein the poles 24 have been generally referred to as PVC pipe, this has been done so merely for convenience of this written description and in no way limits the invention to PVC material or tubeforms in particular, as users ordinarily skilled in the art would readily appreciate a wide array of suitable equivalents.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A ridgepole-less cover system for pontoon boats of the type characterized by horizontal rectangular bars or tubes conventional as the gunwales or top (hand) rails of the left and right (or port and starboard) sides of the boat, said system comprising:

a plurality of elongate flexible poles for flexing into arches across the beam of the boat with the opposite ends of each pole forming the spaced bases of each flexed arch thereof and being a distance apart corresponding to the width of the boat's beam between the left and right top rails thereof;

a multiplicity of bracket assemblies, a pair of each adapted for forming the left and right anchorages for one flexible tube flexed into an arch;

each bracket assembly comprising a zig-zag link, a U-base, and a locking collar;

each zig-zag link having an intermediate seating portion flanked between a lower axle portion and an upper cantilevered-stake portion;

each U-base comprising an inboard and outboard arm spaced by a bottom web wherein said arms and web are sized and adapted for cupping under a top rail of the side of the boat closely along the bottom and sidewalls of said rail, said outboard arm comprising an apertured upward extension and said inboard arm comprising an apertured upward extension, wherein one of the arms transforms into or carries a saddle that accepts a seating member;

wherein said zig-zag link's lower axle portion is sized and adapted for insertion through the apertures in the inboard arm's and outboard arm's upward extension thereby retaining the U-base cupping the side rail; and wherein the zig-zag link's seating portion is seated in the saddle of the U-base to provide positional stability for the zig-zag link in the front to back direction; and each locking collar is sized and adapted for sliding over the U-base's saddle with the zig-zag link's seating portion seated therein in order to retain the zig-zag link from unseating from the U-base;

whereby a single worker at no special job site can trim to size elongate pole stock and flex such into relatively low arches at fore-to-aft spaced locations across the beam of the boat, from rail to rail thereof, and anchor stake pockets on the ends thereof on the upper outer cantilevered-stake portions of oppositely attached bracket assemblies in order to form a rib-cage structure of such arches to support a fabric cover and in consequence obviate the need for any ridge or guy poles.

2. The ridgepole-less cover system for pontoon boats of claim 1 wherein the apertures in the U-base's inboard and outboard arms' upward extensions are located and adapted for resting the zig-zag link's lower axle portion closely upon a top surface of a top rail.

3. The ridgepole-less cover system for pontoon boats of claim 1 wherein the zig-zag link's cantilevered-stake portions are provided with bulbous heads having an outer diameter corresponding closely to the elongate tube stock's inner diameter for a close fit therebetween.

4. The ridgepole-less cover system for pontoon boats of claim 3 wherein the zig-zag link's cantilevered-stake portions are further provided a shoulder or bushing thereon which has have an outer diameter corresponding closely to the elongate tube stock's inner diameter for a close fit therebetween.

5. The ridgepole-less cover system for pontoon boats of claim 1 wherein the elongate tube stock is resilient such that the flexion therein when flexed into arches forces a twist on the opposite bracket assemblies that makes for more secure clamping between the bracket assemblies and the top rails.

6. The ridgepole-less cover system for pontoon boats of claim 1 wherein the inboard arm is provided with the saddle, and the locking collar retains the zig-zag pin's intermediate seating portion from unseating from the saddle by retention against inboard shifting.

7. The ridgepole-less cover system for pontoon boats of claim 6 wherein the inboard arm's apertured upward extension transforms into the saddle such that the U-base arms, web and saddle are a monolithic single piece of material.

8. The ridgepole-less cover system for pontoon boats of claim 1 wherein the poles are produced from pipes, tube forms or other hollow elongate stock such that the stake pockets thereof comprise open ends.

9. A ridgepole-less cover system for pontoon boats of the type characterized by horizontal rectangular bars or tubes conventional as the gunwales or top (hand) rails of the left and right (or port and starboard) sides of the boat, said system comprising:

a plurality of elongate flexible poles for flexing into arches across the beam of the boat with the opposite ends of each pole forming the spaced bases of each flexed arch thereof and being a distance apart corresponding to the width of the boat's beam between the left and right top rails thereof;

a multiplicity of bracket assemblies, a pair of each adapted for forming the left and right anchorages for one flexible tube flexed in an arch;

each bracket assembly comprising a link and a channel base;

each link having an intermediate stop portion flanked between a pin portion and a cantilevered stake portion;

each channel base comprising a pair of arms arm spaced by a web cooperatively sized and adapted for surrounding three sides of a top rail of the side of the boat, both arms comprising and apertured extension spaced away from said web;

wherein said link's pin portion is sized and adapted for insertion through the apertures in both arms' apertured extensions and across the fourth side of the top rail until the stop portion stops against one or the other arms, thereby retaining the channel base on the top side rail;

wherein one of the arms of each channel base transforms into or carries a saddle that accepts a seating member; and wherein the link's stop portion is seated in the saddle of the channel base to provide positional stability for the link during use in resistance to the flex of the pole stock;

wherein each bracket assembly further comprises a locking collar; and wherein each locking collar is sized and adapted for sliding over the channel base's saddle with the link's stop portion seated therein in order to retain the link from unseating from the channel base;

whereby a singe worker at no special job site can trim to size elongate pole stock and fixed such into relatively low arches at fore-to-aft spaced locations across the beam of the boat, from rail to rail thereof, and anchor stake pockets on the ends thereof on the cantilevered-stake portions of oppositely attached bracket assemblies in order to form a rib-cage structure of such arches to support a fabric cover and in consequence obviate the need for any ridge or guy poles.

10. The ridgepole-less cover system for pontoon boats of claim 9 wherein the apertures in the channel base's arms' apertured extensions are located and adapted for resting the link's pin portion closely against a top rail's fourth side.

11. A ridgepole-less cover system for pontoon boats of the type characterized by horizontal rectangular bars or tubes conventional as the gunwales or top (hand) rails of the left and right (or port and starboard) sides of the boat, said system comprising:

a plurality of elongate flexible poles for flexing into arches across the beam of the boat with the opposite ends of each pole forming the spaced bases of each flexed arch thereof and being a distance apart corresponding to the width of the boat's beam between the left and right top rails thereof;

a multiplicity of bracket assemblies, a pair of each adapted for forming the left and right anchorages for one flexible tube flexed into an arch;

each bracket assembly comprising a link and a channel base;

each link having an intermediate stop portion flanked between a pin portion and a cantilevered stake portion;

each channel base comprising a pair of arms arm spaced by a web cooperatively sized and adapted for surrounding three sides of a top rail of the side of the boat, both arms comprising and apertured extension spaced away from said web;

wherein said link's pin portion is sized and adapted for insertion through the apertures in both arms' apertured extensions and across the fourth side of the top rail until the stop portion stops against one or the other arms, thereby retaining the channel base on the top side rail; and wherein the link's cantilevered-stake portions are provided with bulbous heads having an outer diameter corresponding closely to the elongate tube stock's inner diameter for a close fit therebetween;

whereby a single worker at no special job site can trim to size elongate pole stock and flex such into relatively low arches at fore-to-aft spaced locations across the beam of the boat, from rail to rail thereof, and anchor stake pockets on the ends thereof on the cantilevered-stake portions of oppositely attached bracket assemblies in order to form a rib-cage structure of such arches to support a fabric cover and in consequence obviate the need for any ridge or guy poles.

12. The ridgepole-less cover system for pontoon boats of claim 11 wherein the link's cantilevered-stake portions are further provided a shoulder or bushing thereon which has have an outer diameter corresponding closely to the elongate tube stock's inner diameter for a close fit therebetween.

13. The ridgepole-less cover system for pontoon boats of claim 11 wherein the elongate tube stock is resilient such that the flexion therein when flexed into arches forces a twist on the opposite bracket assemblies that makes for more secure clamping between the bracket assemblies and the top rails.

14. The ridgepole-less cover system for pontoon boats of claim 11 wherein the arm provided with the saddle has the saddle opening relatively inboard so that in use the outboard pressure of the flexed poles retains the link's intermediate stop portion from unseating from the saddle.

* * * * *